United States Patent [19]

Holliday

[11] 4,429,503

[45] Feb. 7, 1984

[54] INSULATED PANEL

[75] Inventor: William H. Holliday, Richmond, Va.

[73] Assignee: Reynolds Metals Company, Richmond, Va.

[21] Appl. No.: 192,896

[22] Filed: Oct. 1, 1980

Related U.S. Application Data

[63] Continuation of Ser. No. 53,228, Jun. 29, 1979, abandoned.

[51] Int. Cl.[3] ..... E04B 1/32; E04G 11/04

[52] U.S. Cl. ..... 52/410; 52/249; 52/404; 52/478

[58] Field of Search ..... 52/404, 407, 410, 249, 52/269, 478, 508

[56] References Cited

U.S. PATENT DOCUMENTS

| | | | |
|---|---|---|---|
| 2,074,497 | 3/1937 | Voigt | 52/394 |
| 2,408,292 | 9/1946 | Cardarelli, Sr. | 52/418 |
| 3,245,179 | 4/1966 | Hawkins | 52/410 |
| 3,290,845 | 12/1966 | Snyder | 52/478 |
| 3,412,518 | 11/1968 | Waite | 52/404 |
| 3,427,775 | 2/1969 | Bachrich | 52/404 |
| 3,474,583 | 10/1969 | Manias | 52/404 |
| 3,572,000 | 3/1971 | Gustavsson | 52/404 |
| 3,879,910 | 4/1975 | Waite | 52/410 |
| 4,133,161 | 1/1979 | Lester | 52/537 |
| 4,248,021 | 2/1981 | Dyer | 52/404 |

*Primary Examiner*—Henry E. Raduazo
*Attorney, Agent, or Firm*—Alan T. McDonald

[57] ABSTRACT

An improved insulating panel for tank-like vessels, such as chemical reactors, precipitators and the like is disclosed. The outer surface of the panel is designed so that heat paths from the insulated structure are minimized. This is accomplished by means of a dual fastening system in which surface panels are connected to one another by means of stitching fasteners while the entire panel structure is fastened to its supporting girt by means of mounting fasteners which are positioned beneath the surface panels and which are thus not directly exposed to the outside air. These mounting fasteners are the elements which provide a heat path from the insulated structure to the surface panels and the outside air. Employment of this improved insulation system reduces heat losses through the panels while maintaining cooler surface temperatures on the panels. Both of these features result in reduced heat loss due to convection and radiation.

8 Claims, 3 Drawing Figures

INSULATED PANEL

This application is a continuation of application Ser. No. 53,228, filed June 29, 1979, now abandoned.

BACKGROUND OF THE INVENTION

Many heated vessels are employed in industry. Typical of such vessels are chemical reactors, electrostatic precipitators and the like. Such vessels are either themselves heated or contain materials which have been heated or which generate heat. If such a vessel must be heated, fuels such as oil, natural gas, coal and the like must be burned to supply the energy needed to heat this vessel. In the past, when fuels were far less expensive than currently, insulation of such vessels to retain heat supplied to the vessel was not necessary. However, with the ever increasing fuel costs of today, and with the need to conserve fuel, it has become increasingly important to retain as much heat as possible within the vessel.

Even where such vessels need not be heated, such as in reaction vessels containing exothermic reactions and the like, increased emphasis on safety for plant employees dictates that insulation of these hot vessels be employed.

Thus, for whatever the economic or social reason, it has become increasingly popular, and it is sometimes necessary, to insulate heated vessels. Numerous insulation panels have been developed to meet this need. Most of these panels have in common an outer surface panel, an insulation material and a means for fixing the panel structure to the walls of the vessel.

A problem which is common to the known insulating panel structures for these purposes is the large amount of heat loss which occurs through the panels. This heat loss results from convection and radiation due to the normal high temperatures of the vessel walls which is transmitted from the vessel walls, through the panels and into the outside air. The metal panels their metallic fastening structures act as heat sinks to transmit this heat to the outside air. These heat sinks commonly arise at attachment points between the panels and the vessel walls and occur wherever the vessel walls and the insulation panels come into heat transfer contact. The more surface area of the panels or their supporting structure which contacts the vessel walls, the greater the heat loss. Such heat loss results in reduced insulation efficiency for the panels and an increased surface temperature of the panels as they cover the vessel, which may exceed permissable temperature levels for the health and safety of factory workers, as well as exceeding permissable heat loss values for the purpose of the vessel.

It is desirable, therefore, to produce a panel for insulating structures such as electrostatic precipitators, chemical reactors and the like which reduces substantially heat losses due to convection and radiation through heat sinks and thus increases the insulation efficiency of the panel and reduces the surface temperature of the panel.

THE PRESENT INVENTION

By means of the present invention, these desired results are obtained. The insulating panel of the present invention includes two separate types of fastening elements. The panel surfaces are connected to one another by means of stitching fasteners, which elements pass through the surface panels, but which elements are effectively insulated from the vessel wall. The entire panel structure is fastened to the vessel by means of mounting fasteners which fasten into girts connected to the vessel walls and which are positioned below the outer surface of the outer panels such that the mounting fasteners are not directly exposed to the outside air, thus reducing convection and radiation heat losses through these mounting fasteners. As the means of convection and radiation heat transfer to the outer panel walls is through these mounting fasteners, far less heat transfer occurs than in prior panel structures, thus resulting in lower heat losses and cooler outer panel surfaces than was previously obtainable.

BRIEF DESCRIPTION OF THE DRAWINGS

The panel structure of the present invention will be more fully described with reference to the drawings in which.

DETAILED DESCRIPTION OF THE PREFERRED EMBODIMENT

Figure 1:
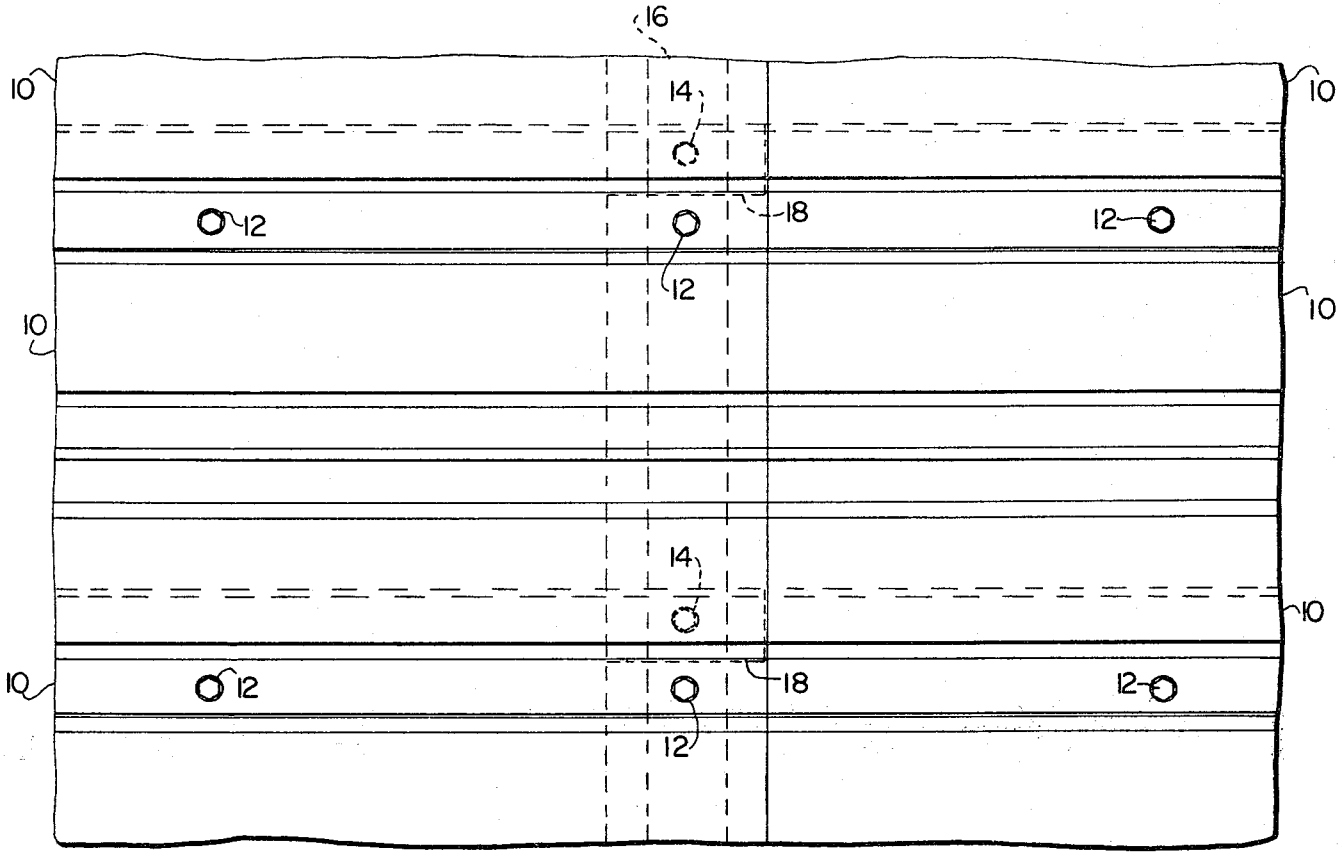
FIG. 1 is a front elevational view illustrating the connection to one another of a plurality of panels according to the present invention.
Figure 2:
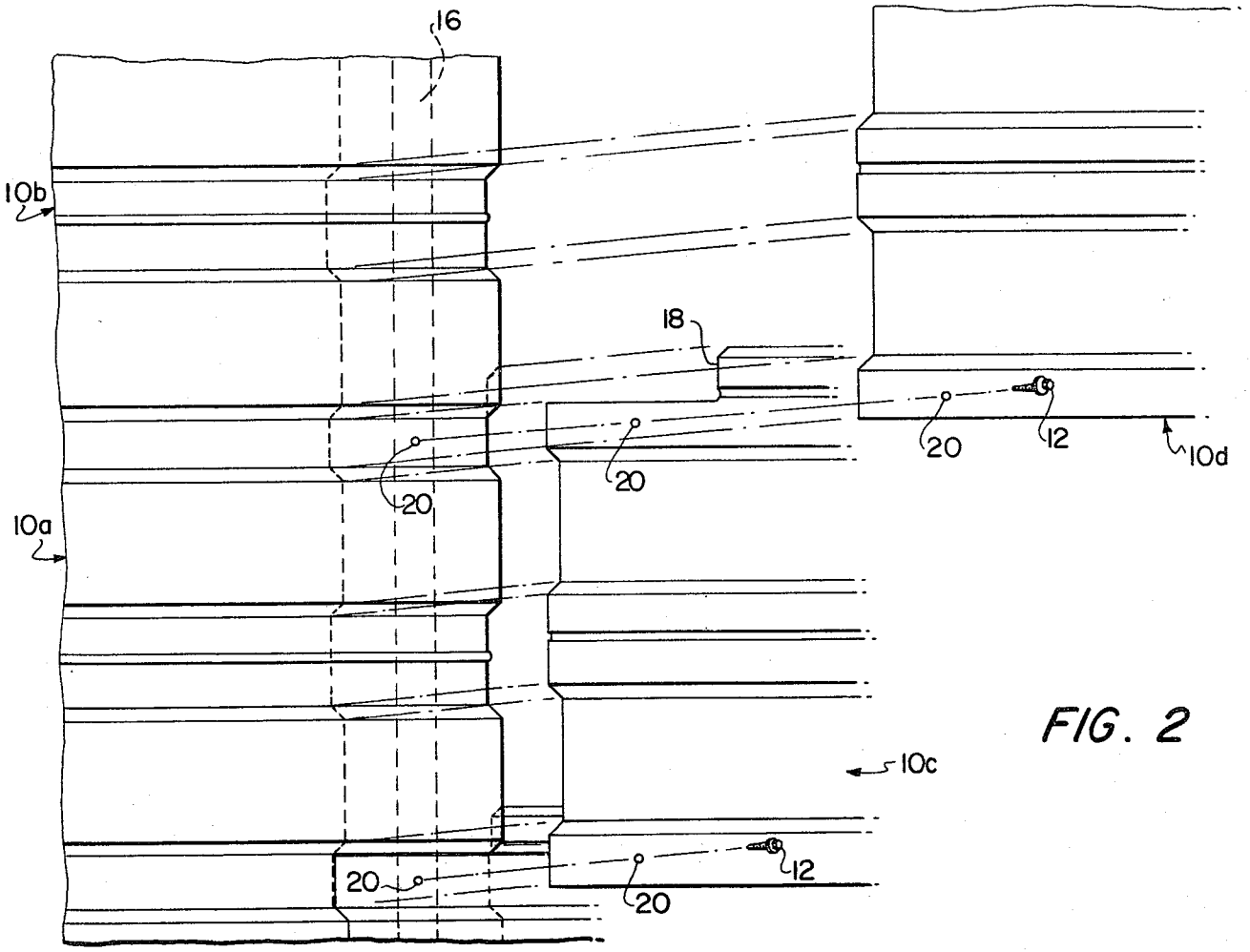
FIG. 2 is an exploded view illustrating the fastening of panels to one another.

Turning now to FIGS. 1 and 2, a plurality of panels 10 are shown. In FIG. 1, six separate panels 10 are partially illustrated. The panels 10 are fastened along side laps thereof to one another by means of stitching fasteners 12, such as metal stitching screws. The panels 10 are fastened to the surface of the vessel which they insulate by means of mounting fasteners 14, such as metal screws, which fasten the panels 10 to a girt 16, which girt 16 is in turn fastened to the wall of the vessel, as will be more fully described below. The stitching fasteners 12 may occur at the girts 16 and/or spaced from the girts 16.

FIG. 2 illustrates the assembly of panels 10 to one another at end laps thereof, according to the present invention. In FIG. 2, panels **10*a* and 10*b* have been fastened in place previously. Panel 10*c* is placed over panel 10*a* with the notched portion 18 of panel 10*c* fixing the horizontal overlap of panel 10*c* over panel 10*a*. Panel 10*d* is then placed over panel 10*b*, with a similar notched region (not shown) again fixing the horizontal overlap. Stitching fasteners 12, such as metal screws, pass through openings 20 in panels 10*a*, 10*b*, 10*c* and 10*d*, as illustrated, to lock the outer panel surfaces to one another. Each end lap occurs at a girt 16**, as illustrated.

Figure 3:
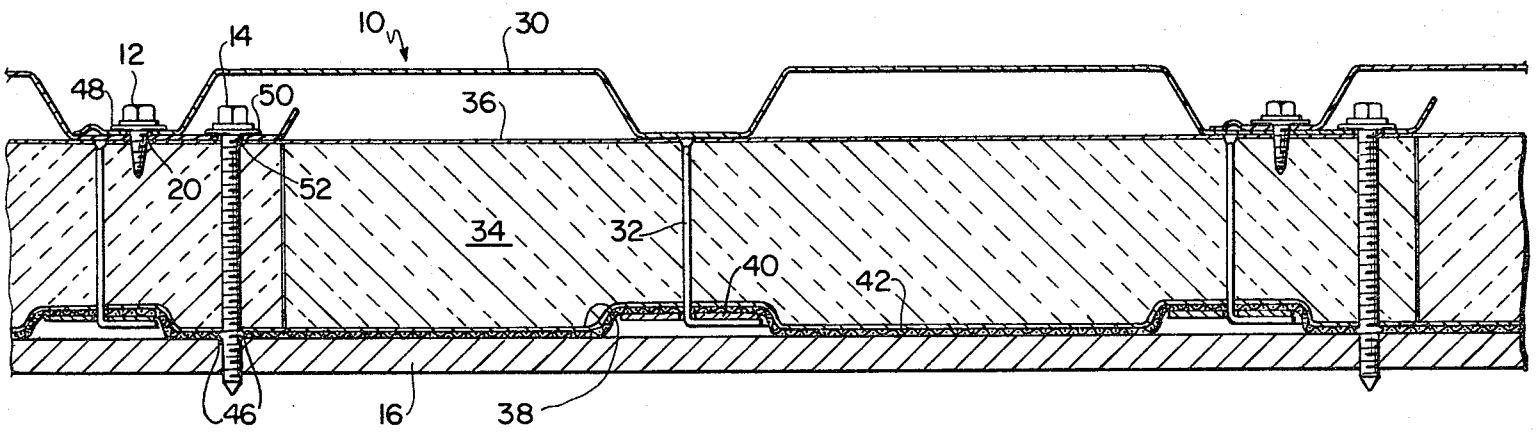
FIG. 3 is a cross-sectional view illustrating the panel structure of the present invention.

FIG. 3 illustrates the panel structure of the present invention, and the fastening of the panel structure to a vessel wall. It should be noted that while FIG. 3 illustrates the structure as horizontal, it will be appreciated that, in actual practice, this structure will be vertical.

The panel structure 10 includes a plurality of overlapping surface panels 30. These surface panels 30 are formed of sheet metal, such as aluminum or steel. Preferably, these panels 30 are formed of aluminum sheet. The surface panels 30 overlap one another both vertically and horizontally by means of the side laps and end laps previously described, and are fastened to one another through openings 20 by means of stitching fasteners 12 having sealing washers 48, such as rubber washers. The panels 30 also include a plurality of pins 32 attached thereto. These pins help hold thermal insulation material 34 in place. Thermal insulation material 34 may be formed of mineral wool, fiber glass, rock wool, and other insulation-type materials. Preferably, this insulation material 34 is formed of rock wool. To provide additional thermal resistance, the insulation batt 34 is preserably covered on its surfaces with metallic foil barrier layers 36 and 42, such as aluminum foil, although one or both of these layers may not be required. The insulation batt 34 is placed over the pins 32, prior to assembly of the panel structure, wire mesh 38, such as chicken wire, is placed over the insulation batt 34, means for holding the batt 34 and the wire mesh 38 onto the pins 32, such as metallic washers 40, are placed onto the pins 32, the insulation material 34 and the wire mesh 38, and the pins 32 are bent to hold the insulation batt 34 in place, along with the wire mesh 38. It should be noted that the pins 32 are individual pins and are not tracks between which the insulation batt 34 may slide into place. The panels 30, having the insulation material 34 attached thereto, are placed over a girt 16. Girt 44 is the fastening base for the panel structure 10. Girt 16 is a metal strip and is attached either adhesively or by fastening elements, such as bolts, to a vessel wall (now shown). Preferably, the pins 32 are spaced such that the pins 32 do not fall at the girts 16. Should a pin 32 fall at a girt 16, however, the increased heat flow therefrom is slight, and will not adversely affect the effeciency of the panel structure 10.

The panel structure 10 is fastened to girt 16 by means of mounting fasteners 14. Heat transfer from the vessel wall can pass through girt 16 and the mounting fasteners 14. Thus, mounting fasteners 14 are positioned below the outer surface of the panel structure 10 by locating openings 52, through which mounting fasteners 14 pass, in a region of the panel 30 which is overlapped by another panel 30, so that mounting fasteners 14 are below the outer surface of the panel structure 10 and are not directly exposed to the outside air. Thus, the path for heat transfer by convection and radiation is through the girt 16, the mounting fasteners 14 and along the panel 30 from openings 52 toward stitching fasteners 12. This path is relatively long, and less heat transfer can occur in this manner than occurs in prior panels where direct heat paths result.

Preferably, mounting fasteners 14 are stand-off screws having tabs 46 thereon to limit the depth of entry of the mounting fasteners 14 into girt 16, to provide for easy and accurate installation. However, this is not a requirement and plays no part in the structure of the present invention.

From the foregoing, it is clear that the panel structure of the present invention provides an insulating panel which reduces available paths for heat transfer and thus reduces heat loss from the insulated vessel.

While presently preferred embodiments of the present invention have been illustrated, it will be understood that the invention may be otherwise variously embodied and practiced but within the scope of the following claims.

I claim:

1. In a panel structure for heat insulating vessels, said panel structure comprising a plurality of surface panels, heat insulation material, means for fastening said surface panels to one another and means for fastening said panel structure to said vessel, the improvement wherein said means for fastening said surface panels to one another comprises stitching fasteners, said stitching fasteners being out of direct thermal contact with said vessel and said stitching fasteners having their heads directly exposed to outside air and wherein said means for fastening said panel structure to said vessel consists of mounting fasteners, said mounting fasteners being in direct thermal contact with said vessel and said mounting fasteners being entirely located beneath the outside surface of said panel structure such that said mounting fasteners are not directly exposed to outside air, said mounting fasteners providing the sole direct thermal contact link between said vessel and said surface panels, whereby heat losses from said vessel through said panel structure by means of said stitching fasteners and said mounting fasteners are reduced to a minimum and easy access to said vessel through said panel structure is provided.

2. The structure of claim 1 wherein said panel structure comprises a plurality of surface panels, insulation batts, pins connected to said surface panels for holding said insulation batts, wire mesh and means for holding said insulation batts and wire mesh onto said pins.

3. The structure of claim 2 wherein said insulation batt is covered on at least one surface thereof with metallic foil.

4. The structure of claim 3 wherein said metallic foil is aluminum foil.

5. The structure of claim 2 wherein said means for holding are metallic washers.

6. The structure of claim 2 wherein said insulation batt is a rock wool batt.

7. The structure of claim 1 wherein said surface panels are aluminum panels.

8. The structure of claim 1 wherein said mounting fasteners are stand-off screws.

* * * * *